US007121422B2

(12) United States Patent
Gitschlag et al.

(10) Patent No.: US 7,121,422 B2
(45) Date of Patent: Oct. 17, 2006

(54) DISPOSABLE PLATE HAVING IMPROVED ERGONOMICS

(75) Inventors: John Stewart Gitschlag, Chicago, IL (US); Stephen Alan Smith, Naperville, IL (US); James Tam Joines, Jr., Gurnee, IL (US); Kimberly Vaile Healy, Chicago, IL (US); Warren Giles Wiedmeyer, Trevor, WI (US); Bryce G. Rutter, St. Louis, MO (US); John Howard Loudenslager, Phoenix, AZ (US); Ryan J. Bruce, Tempe, AZ (US); Brian C. Bone, St. Louis, MO (US); Jan R. Stillerman, Phoenix, AZ (US)

(73) Assignee: Solo Cup Operating Corporation, Highland Park, IL (US)

( * ) Notice: Subject to any disclaimer, the term of this patent is extended or adjusted under 35 U.S.C. 154(b) by 110 days.

(21) Appl. No.: 10/277,010

(22) Filed: Oct. 21, 2002

(65) Prior Publication Data

US 2004/0074909 A1 Apr. 22, 2004

(51) Int. Cl.

| | |
|---|---|
| ***A47G 19/00*** | (2006.01) |
| ***A47G 21/00*** | (2006.01) |
| ***A47G 23/00*** | (2006.01) |

(52) U.S. Cl. ..... 220/575; 220/556

(58) Field of Classification Search ..... 220/574, 220/575, 556; 229/406, 407

See application file for complete search history.

(56) References Cited

U.S. PATENT DOCUMENTS

| | | | | |
|---|---|---|---|---|
| 1,440,070 A | | 12/1922 | Fry | |
| D88,343 S | | 11/1932 | Dowd | |
| D166,934 S | | 6/1952 | Slobodkin | |
| 2,700,284 A | | 1/1955 | Lyon, Jr. | |
| D184,875 S | | 4/1959 | Johnson | |
| D185,067 S | | 5/1959 | Clark, Jr. | |
| 3,099,377 A | * | 7/1963 | Metzler et al. | 229/406 |
| D197,574 S | * | 2/1964 | Gulotta | D7/545 |
| 3,250,419 A | * | 5/1966 | O'Brien et al. | 220/574 |
| 3,938,727 A | | 2/1976 | Andersson | |
| D244,245 S | | 5/1977 | Jensen | |
| D244,247 S | | 5/1977 | Jensen | |
| D248,076 S | | 6/1978 | Christian | |
| D265,707 S | | 8/1982 | Pickard | |

(Continued)

FOREIGN PATENT DOCUMENTS

| | | |
|---|---|---|
| DE | 2301215 | 7/1974 |

(Continued)

OTHER PUBLICATIONS

Die Modernen, *Schoner Wohenen*, Jul. 1989, p. 94.

(Continued)

*Primary Examiner*—Nathan J. Newhouse
*Assistant Examiner*—Harry Grosso
(74) *Attorney, Agent, or Firm*—Wallenstein & Wagner, Ltd.

(57) ABSTRACT

A disposable plate for carrying and serving food is disclosed. One particular aspect of the invention includes a plate with a substantially circular food-contact area with a substantially oval rim periphery. The rim is formed to make the plate easy to hold, with grooves adapted to accommodate fingers and/or thumbs. The present invention may be designed to segment the food storage areas of the plate into multiple compartments by using a divider wall. Also, the food-contact area can be slightly domed to force food to shift to the outer portion of the food-contact area and inhibit the food from slipping to the middle of the plate, thus keeping the plate center from sagging.

25 Claims, 5 Drawing Sheets

U.S. PATENT DOCUMENTS

| | | | | | |
|---|---|---|---|---|---|
| D288,050 | S | | 2/1987 | Fox et al. | |
| D296,640 | S | | 7/1988 | Miller | |
| D303,196 | S | | 9/1989 | Unger | |
| D310,930 | S | | 10/1990 | Unger | |
| 4,966,295 | A | | 10/1990 | Parrish | |
| D312,750 | S | | 12/1990 | Unger | |
| D313,922 | S | | 1/1991 | Scherer | |
| D314,884 | S | | 2/1991 | Unger | |
| D322,539 | S | | 12/1991 | Under | |
| D322,737 | S | | 12/1991 | Unger | |
| 5,114,038 | A | | 5/1992 | Laumann get. Quensen | |
| D337,025 | S | | 7/1993 | Merwin et al. | |
| D337,485 | S | | 7/1993 | Merwin et al. | |
| D343,338 | S | * | 1/1994 | Bucher et al. | D7/543 |
| D345,893 | S | | 4/1994 | Jaworski | |
| D346,934 | S | | 5/1994 | Littlejohn | |
| D370,598 | S | | 6/1996 | Koch | |
| D373,053 | S | | 8/1996 | Allegre | |
| D373,509 | S | | 9/1996 | Bormioli | |
| D376,295 | S | | 12/1996 | Ahern, Jr. et al. | |
| 5,607,077 | A | | 3/1997 | Torkelson | |
| 5,662,240 | A | | 9/1997 | Norris | |
| D386,048 | S | | 11/1997 | Bebawey | |
| 5,695,052 | A | | 12/1997 | Damato | |
| 5,758,773 | A | | 6/1998 | Clements | |
| D405,561 | S | | 2/1999 | Willinger et al. | |
| D417,584 | S | | 12/1999 | Lillelund et al. | |
| D420,856 | S | | 2/2000 | Yeo et al. | |
| D424,881 | S | | 5/2000 | Sundberg | |
| 6,062,418 | A | | 5/2000 | Rathjen | |
| D432,360 | S | | 10/2000 | Greene | |
| D433,878 | S | | 11/2000 | Joergensen | |
| D434,605 | S | | 12/2000 | Littlejohn et al. | |
| D438,063 | S | | 2/2001 | Indekeu | |
| D445,303 | S | | 7/2001 | Littlejohn et al. | |
| D445,304 | S | | 7/2001 | Littlejohn et al. | |
| D450,221 | S | | 11/2001 | Littlejohn et al. | |
| D452,118 | S | | 12/2001 | Benson | |
| D452,417 | S | | 12/2001 | Whitmore et al. | |
| 6,401,955 | B1 | | 6/2002 | Yang | |
| 6,401,962 | B1 | | 6/2002 | Littlejohn et al. | |
| 6,561,375 | B1 | * | 5/2003 | Nagy | 220/574 |
| D494,816 | S | * | 8/2004 | Wiedmeyer et al. | D7/543 |
| D494,817 | S | * | 8/2004 | Rutter et al. | D7/543 |
| D497,774 | S | * | 11/2004 | Smith et al. | D7/543 |
| D498,980 | S | * | 11/2004 | Smith et al. | D7/549 |
| D499,936 | S | * | 12/2004 | Wiedmeyer et al. | D7/545 |

FOREIGN PATENT DOCUMENTS

| | | | |
|---|---|---|---|
| FR | 2592571 | * | 7/1987 |
| GB | 21703 | * | 9/1892 |
| GB | 6206 | * | 5/1894 |
| GB | 583882 | | 1/1947 |

OTHER PUBLICATIONS

Photos 1(a)-1(d) of plate; Hema B.V. Postbus 23220 1100 DS, Amsterdam, Netherlands.
Photos 2(a)-2(e) of bowl.

* cited by examiner

DISPOSABLE PLATE HAVING IMPROVED ERGONOMICS

TECHNICAL FIELD

The present invention relates to devices for the carrying or serving of food and more particularly to sturdy disposable plates having integral handles, making the plate easier to carry and hold.

BACKGROUND OF THE INVENTION

Disposable plates are usually designed with enough durability to be reused, but they are intended to be used only once and then discarded. Disposable plates are usually inexpensive to manufacture, sold in bulk quantities, and not typically fragile. In contrast, reusable plates are expensive to manufacture, sold in small sets (usually 4 or 8), and can be quite fragile. Because of these features, disposable plates are often utilized at buffets or picnics and the like, and for meals where a large number of people make it undesirable to use nondisposable or reusable plates. Typically, the disposable plates are stacked, one on top of another, for use at such events, so that a person may select a plate and then serve himself.

Disposable plates have a long history of use and have been manufactured from a number of distinct materials. Reusable plates made of materials such as glass or ceramic have different structural concerns than most disposable plates. For example, reusable plates are generally heavier and sturdier than their disposable counterparts, but may be susceptible to chipping or breaking.

Disposable plates evolved from durable or reusable plates made from a variety of materials. Pewter tableware was popular and affordable in the eighteenth century, although other materials were considered more desirable. Decorated glazed porcelain plates were also popular, whereas earthenware was seen as a disfavored material. Solid silverware was out of the price range of most people, however, silver-plated tableware made an affordable alternative. In the nineteenth century, a blue and white pattern was popular on plate designs from stoneware to bone china. Pyrex or borosilicate glass tableware with heat-resistant properties was introduced in the early 1900's. The perception of materials desirable for plates has changed since the beginning of the last century. The materials used in manufacturing and the selling price of a plate tend to help catagorize the plate as disposable or reusable.

Service style is the way that food is presented to guests or the type of service offered to guests. Service styles are as numerous as cultures and nations on earth. The styles of service can range from elegant and lavish to very informal. Disposable tableware has generally been best suited to informal service situations.

Plates and food containers heretofore devised and utilized are known to consist basically of familiar expected and obvious structural configurations. The myriad of plate designs encompassed by the crowded prior art has been developed for the fulfillment of countless objectives and requirements. The structural concerns of durable and reusable plates are significantly different than those of disposable plates. Some of the most general requirements of disposable tableware are that they are economical, easy to hold and carry, and that the plates deter the spilling of food.

Disposable plates have significant material distinctions. Low-cost tableware of light construction are customarily economically manufactured on a large production basis.

Lightweight paper plates are well-suited for dry foods. A pulp paper heavy-duty product creates a better quality of paper plate: it is good for serving hot foods; it is heat and cut resistant; and, it is economical and cost efficient for a large group. Laminated foam dinnerware provides a degree of cut-resistance and is a durable alternative. The lamination keeps food from soaking through the plate while the foam insulates against heat transfer. Non-laminated plates are less expensive yet practical for light menus. Plastic tableware is another alternative available in several designs and levels of quality. Heavy-duty plastic tableware is sold in a wide variety of colors and is both heat and cut resistant.

There are several problems associated with plates today. Issues with durable plates include a relatively high price, a need to clean them after use, and the difficulty in carrying or transporting reusable plates that were not designed for mobility. Even disposable plates have long had structural problems. These problems include a lack of significant rigidity, buckling or sagging from the weight of its contents, food sliding about the plate, food becoming co-mingled with other incompatible food, and the plate being difficult to hold or carry.

In the past, some disposable plates have had a tendency to be less rigid than similar dimensioned traditional reusable plates. The relative lack of structural rigidity is manifested by such plates bending, sagging, or folding between the portions of the plate being held, particularly when the plates are toting a heavy load. The items on the plate may settle into the middle of the plate, making the plate sag or buckle at its center. This exacerbates the problem as the sagging middle of the plate draws food from the perimeter down into the center. Eventually a large share of the weight of the items on the plate is gathered in the small area around its center. Food items being spread out and settled on the outer edges of a plate's food-contact area would enhance a loaded plate's rigidity, but food sometimes gravitates toward the center of the plate and this has a tendency to bow it down, further inducing food to slide to the middle of the plate.

There has always been a need for disposable plates that allow for the segregation of items placed on the plate. On low friction surfaces, such as the food-contact area of a smooth plastic plate, food may slide around the plate while the plate is being carried. Separation helps avoid blurring particular culinary distinctions. Examples include grease mixing with gravy and destroying their individual culinary flavors, or the sauce of baked beans being absorbed to soggy a hamburger bun. There is a need to hold the solid food items in the position that they were placed on the plate. To solve this, those skilled in the art have provided plate dividers to form isolated compartments on the face of the food-contact area of the plate. The dividers could aid in keeping different food elements separate, but could also induce a propensity for the disposable plate to fold along the line of the divider.

Carrying a disposable plate causes yet another inconvenience. Traditionally, a plate's food-contact area and rim form concentric circles of increasing size. The rim of the plate lacks a solid spot to grab and hold onto the entirety. A small circular rim encircling the food area of the plate leaves little room to grasp the plate while it is full. This drawback is especially relevant when one attempts to serve food onto the plate with one hand while holding the plate with the other hand. There is typically no handle or convenient method of holding a flimsy disposable plate, particularly when the plate is loaded with food. Additionally, placing a hand underneath the plate and carrying the plate like a tray or platter has the disadvantage of transferring the heat of potentially hot food to the fingers of those holding the plate in this fashion. Trays, platters, and even some plates, however, do have handles, but these handles tend to be manufactured of the same smooth substance that make up the balance of the plate and may therefore be difficult to hold.

The present invention is provided to solve these and other such problems with prior art devices.

SUMMARY OF THE INVENTION

The present invention provides a light, inexpensive, easily carried, easily held, disposable plate or bowl for the carrying and serving of food.

An aspect of the disclosed invention is a bowl or plate having a substantially circular food-contact area for receiving the food items and a raised oval, elliptical, rounded end, or obround plate rim. The substantially circular and oval combination create a stylish and functional blend of features where the rim is narrow along the minor axis of its oval perimeter and wider along the major axis. The wider portions of the rim naturally form handles that are conducive to having two hands holding opposite sides of the oval, elliptical, rounded end, or obround plate rim.

Another embodiment of the invention is a plate having a domed food-contact area. By having a substantially circular food-contact area that is slightly domed, the rigidity of the food holding portions of the plate is enhanced. Structural integrity is increased as the weight of the supported load is spread to the periphery of the substantially circular food-contact area. Individual compartments of a compartmentalized plate can also incorporate this feature on a smaller scale by having compartments whose substantially circular food-contact area is pitched toward the outside periphery.

Another embodiment of the disclosed invention has handles on the rim to grip the plate. These handles can include finger and/or thumb grooves for ease of holding and carrying the plate. The handles and especially their thumb grooves can be dimensionally optimized to balance ease of use with plate rigidity. The finger grooves can be located on the rim or on the underside of the food-contact area, so as to promote the ability to carry the plate and its contents with one hand.

In another embodiment of the invention, the plate has asymmetrical compartments formed by a dividing wall. Dividing walls are preferably "S" shaped to create two or more unequally sized compartments or sections. The dividing wall can be curved to discourage the plate from folding along a straight line of the dividing wall.

Other features and advantages of the invention will be apparent from the following specification taken in conjunction with the following drawings.

BRIEF DESCRIPTION OF THE DRAWINGS

In order to better describe the features of the present invention, a number of drawing figures are appended hereto in which.

DETAILED DESCRIPTION OF THE PREFERRED EMBODIMENT

Figure 1:
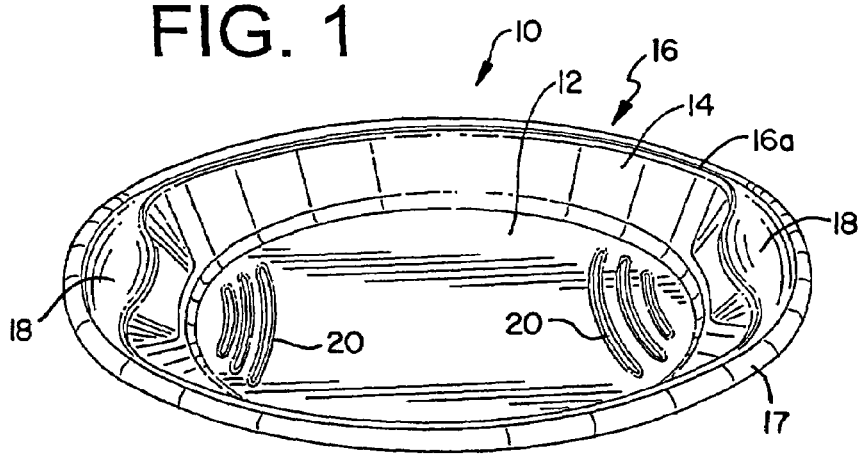
FIG. 1 is a perspective view of a plate, showing the substantially circular food-contact area with the oval rim of the plate.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring generally to the appended FIGS. 1–12, the embodiment of FIG. 1 is generally referenced by the number 10 in the following disclosure and drawings. Other components are similarly and consistently numbered throughout the specification and drawings. While the features of the present invention are preferred for use with thermoplastic containers, such as, for example, bowls, plates, food containers, and the like, manufactured by the SOLO CUP COMPANY of Highland Park, Ill., other such disposable materials for containers, bowls and plates may be capable of adaptation for implementation of these features as well. Some of the materials that can be used to manufacture disposable plates include, but are not limited to, plastics including thermoplastics and thermoset, fiber and molded fiber, foam, paper, cardboard, biodegradable materials, materials modified with lamination, fillers, or extenders and other plastic materials.

As shown in FIG. 1, the disposable bowl or plate 10 has a substantially circular recessed surface or food-contact area 12 with a top side to receive food or other items to be put on the plate 10. The underside of the substantially circular food-contact area 12 is shown as the surface where the plate 10 is set down, such as on a table or counter top. Both the top and underside of the substantially circular food-contact area 12 of the plate 10 are relatively smooth. The smooth top side of the substantially circular food-contact area 12 allows items placed on the plate 10 to slide around it, whereas the smooth bottom side can allow the plate 10 to slide or be pushed easily across a surface. The substantially circular food-contact area 12 forms an ideal location for the placement of a logo. A plate logo or brand indication may be helpful in creating brand name recognition for marketing the plate 10.

Using one production method, a plate 10 having a sharp corner at the intersection of the circular food-contact area 12 and sidewall is formed. Using well-known thermoforming techniques, a radius, also known as a fillet, is imparted at this intersection to form a rounded corner. Some fluctuation has been found to occur such that the circular food-contact area 12 is not always perfectly round. The intent is, nonetheless, to produce a plate 10 having a circular food-contact area 12 and an elliptical rim 16 portion.

The disposable plate 10 is shown having a sidewall 14 whose lower end is integral with the substantially circular food-contact area 12. The sidewall 14 loops around the entire perimeter of the substantially circular food-contact area 12 to keep food or other items from falling off the food-contact area 12. The sidewall 14 is preferably positioned at an angle α slightly greater than perpendicular to the substantially circular food-contact area 12 for ease of placing food on the plate 10 and keeping the food from sliding off the plate 10. The upper end of the sidewall 14 is also attached to the rim 16 of the plate 10. The rim 16 of the plate 10, shown in FIG. 2, has a substantially circular center which is just slightly larger than the diameter of the substantially circular food-contact area 12 to make up for the sidewall 14 obtuse angle α that is greater than 90 degrees, preferably in the range of 90 degrees to about 180 degrees. The outer perimeter of the rim 16 is substantially oval. The dissimilar shapes of the rim's substantially circular interior and oval perimeter give the server ready-made thumb handles 18 for gripping and holding the plate 10.

Figure 2:
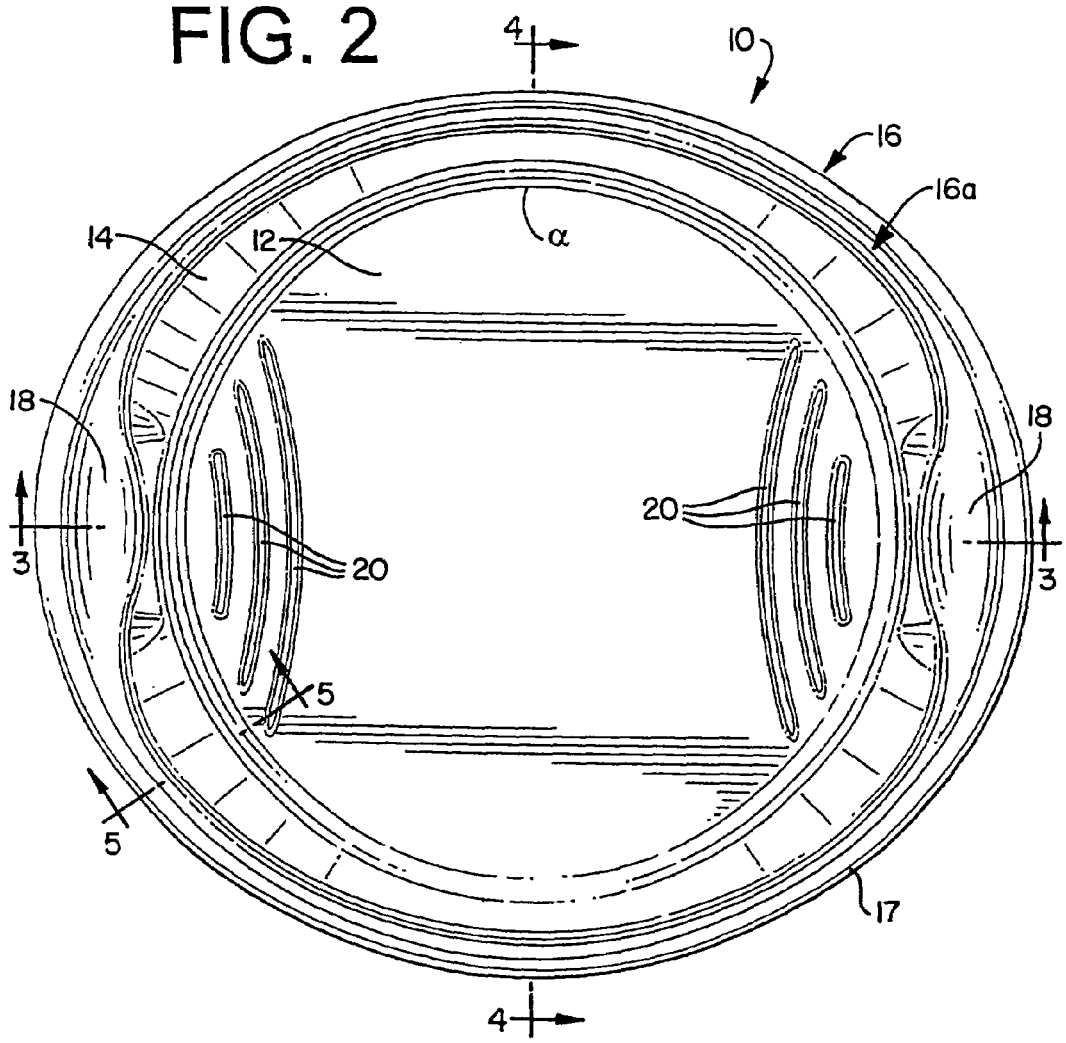
FIG. 2 is a top view of the plate of FIG. 1, showing the thumb handles and finger tactile areas.

As shown in FIG. 2, the widest portions of the rim 16 form thumb handles 18 and preferably include an indentation or depression on each end for the placement of the thumbs of the user. This indentation preferably narrows and wraps around the entire plate creating a curve in the curled-down rim 16. The extra curve of the down-turned rim 16 adds rigidity to the plate 10. Another benefit of this feature is to give the user a better grip on the thumb handles 18 of the plate 10. The substantially circular food-contact area 12 has finger tactile areas 20 on the portion of the substantially circular food-contact area 12 nearest the thumb handles 18. The finger tactile areas 20 are positioned so that the user can hold the plate 10 and carry its contents with one hand. The finger tactile areas 20 are located on the underside of the plate 10 for a user to feel where to optimally situate his or her fingers and to provide an enhanced plate gripping surface. For example, the user can place his or her thumb on top of either thumb handle 18 of the length of the oval rim 16. The user's fingers naturally curl under the plate 10 and come to rest on the tactile area 20 on the bottom surface of the substantially circular food-contact area 12. The fingers and thumb of the hand that is holding the plate 10 clench the plate 10 between the top of the thumb handles 18 of the rim 16 and the under side of the substantially circular food-contact area 12. A preferred embodiment forms finger tactile areas 20 with concentric arcs on the substantially circular food-contact area 12 near the thumb handles 18 of the rim 16. The finger tactile area 20 can also be a group of bumps, waves, a textured region, or the like, which achieves the purpose of grasping the disposable plate 10 in one hand.

Figure 3:
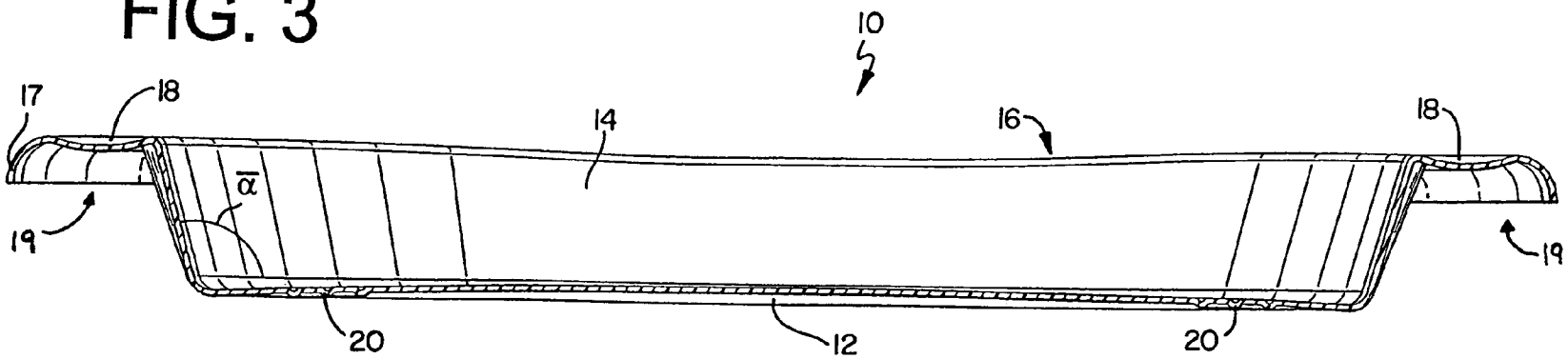
FIG. 3 is a side view of the plate of FIG. 1 cut along the major axis, showing the domed food-contact area, sidewall, and the handle forming rim.

Referring now to FIG. 3, the embodiment of the disposable plate shown is a cross-section of the plate of FIG. 1. The thumb handles 18 on the rim 16 of the plate 10 can be seen on each end of the cross-section of the plate 10. The height of the sidewall 14 has been increased relative to the traditional standard of plate sidewalls. The increased length of the angled sidewall 14 provides the plate 10 with a deeper receptacle or food-contact area 12 to reduce the possibility of spilling the contents of the plate 10 because of the general portability and mobility requirements of disposable plate applications.

The sidewall 14 and rim 16 of the plate 10 have a contemplated purpose of maximizing structural strength and rigidity while fulfilling the ergonomic and ornamental intentions for disposable plates. The sidewall 14 height and angle α are preferably varied. The sidewall 14 can be highest near the thumb handles 18 and lowest at the midpoints of the sidewall 14, between the two thumb handles 18. The angle α between the food-contact area 12 and the sidewall 14 can also be dynamic. Preferably, the angle α is about 90 degrees or perpendicular at the midpoints of the sidewall 14. The angle α can increase, toward, but less than 180 degrees, as the sidewall 14 approaches the thumb handles 18. The angle α of the sidewall 14 neighboring the thumb handles 18 preferably decreases again to approximately 90 degrees along the line of the plate's major axis to provide for a strong and comfortable gripping location.

The rim 16 dimensions may also be varied. The rim's skirt, or vertical downturn flange 17, can add rigidity to the plate 10, wherein the rim 16 and the flange 17 cooperate to define an annular cavity 19 below an underside of the rim 16 (see FIGS. 3–5). The rim 16 preferably has the least downturn nearest the midpoints of the sidewalls 14 and the most downturn nearest the thumb handles 18. The described rim 16 configuration has structural benefits as well as providing the plate 10 a side view alignment of the end of the rim's skirt 17 that appears parallel to both the perimeter of the food-contact area 12 and parallel to the surface on which the plate 10 is placed. An example of the sidewall 14 and rim 16 height and angle α fluctuations can be readily observed by comparing FIGS. 3, 4, and 5. FIG. 5 is a cutaway view of the plate 10 between the major and minor axis in contrast to FIGS. 3 and 4, particularly showing a greater angle α. The angle α between the food contact area 12 and the sidewall 14 preferably changes around the perimeter of the plate 10 with an angle α nearly perpendicular at the thumb handles 18, the angle α becoming larger and then approaching 90 degrees again near the minor axis. In another preferred embodiment, there are further undulations forming waves in the rim 16 and providing additional rigidity to the plate 10, such as a groove 16*a* (see FIGS. 2, 4 and 5).

Figure 4:
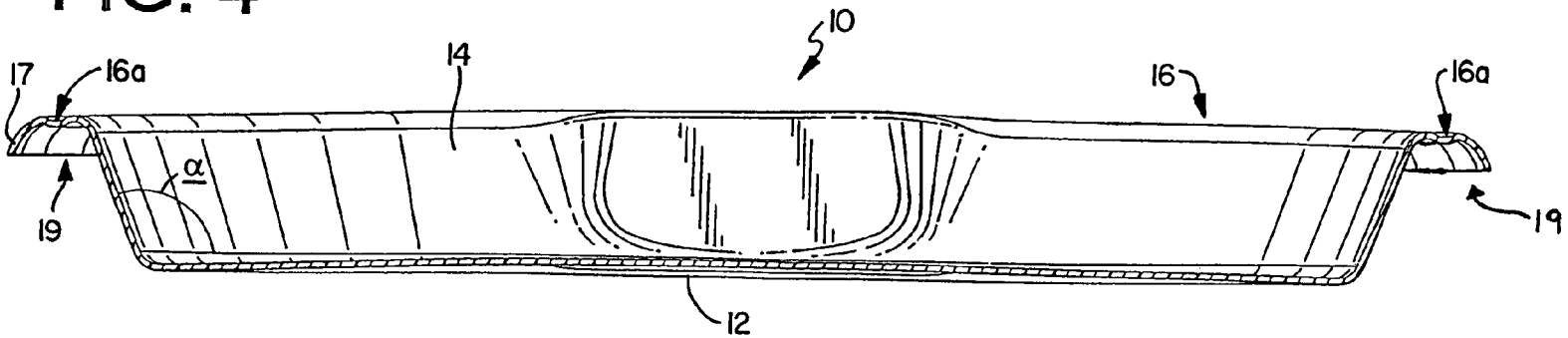
FIG. 4 is a side view of the plate of FIG. 1 cut along the minor axis, showing the domed food-contact area, sidewall, and the rim.
Figure 5:
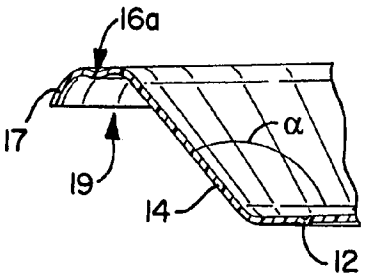
FIG. 5 is a cut away view of the sidewall of the plate of FIG. 1.

FIG. 4 shows an embodiment of the disposable plate 10 having a domed food-contact area 12. The perimeter of the substantially circular food-contact area 12 can rest firmly on a table or other surface while the center of the food-contact area 12 is slightly raised. Various heights of the domed food-contact area surface 12 can optimize the plate's use for specific applications. The doming of the food-contact area 12 creates a greater resistance to the perpendicular gravitational force from the weight of the food or other items placed on the plate 10. The domed food-contact area 12 guides food to drift toward the perimeter of its circle, particularly liquid or fluid items placed on the plate 10. The drifting distributes the weight of the items on the plate 10 around the periphery of the substantially circular food-contact area 12, allowing for a greater load. A domed substantially circular food-contact area 12 serves to draw a fluid foodstuff away from the food it is commingling with. For example, grease, which can be a necessary but an unwanted byproduct of meal preparation, will drain to the edges of the substantially circular food-contact area 12, preserving the rest of the food, centered in the plate, from saturation.

Figure 6:
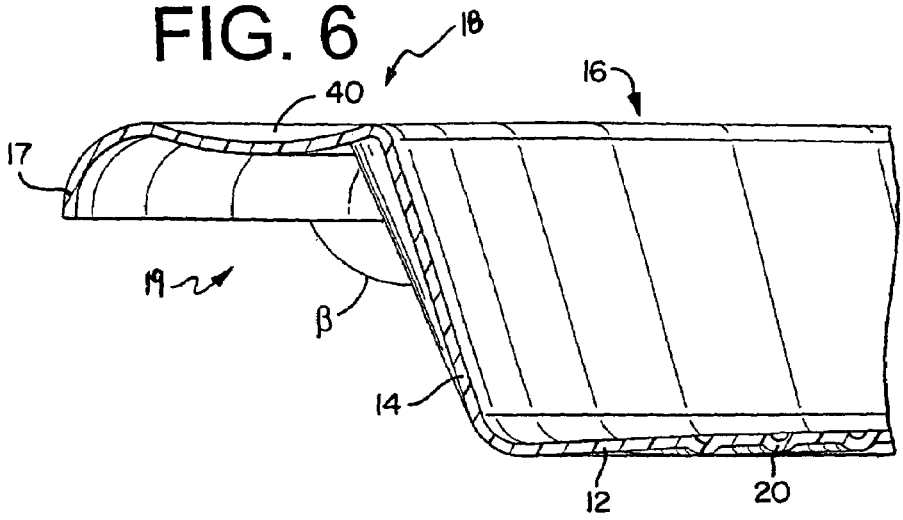
FIG. 6 is a cut away view of the plate thumb handle of the plate of FIG. 1.

FIG. 6 is a view of the plate's thumb handle 18. The gripping portion 40 of the thumb handle 18 is widest along the major axis and progressively narrows into the rim further from the major axis, creating a lens-like shape. The gripping portion 40 is bowed slightly to curve downward and provide a convenient, comfortable resting spot for the pads of the user's thumbs on the top of the thumb handles 18. The arch narrows and forms the rim further away from the major axis. The width and extended skirt vertical flange 17 downturn are preferably largest at the center of the thumb handles 18. The angle β formed between the thumb handles 18 and the sidewall 14 is slightly greater than perpendicular, between 90 and 180 degree, preferably about 100 degrees.

Figure 7:
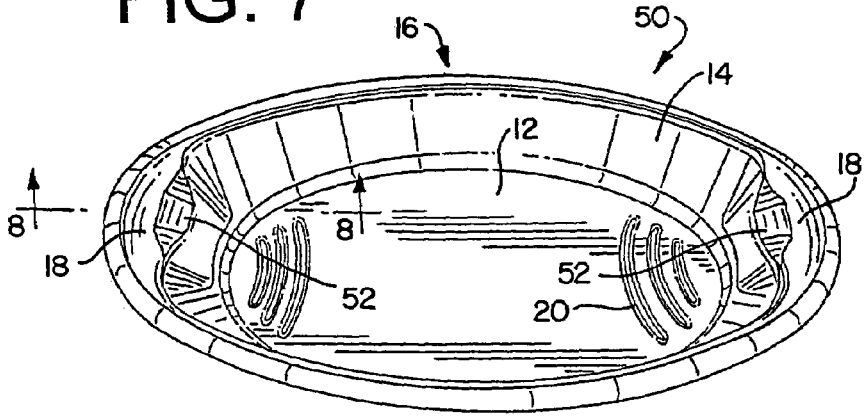
FIG. 7 is a perspective view of a plate having a gusset in the thumb handles.
Figure 8:
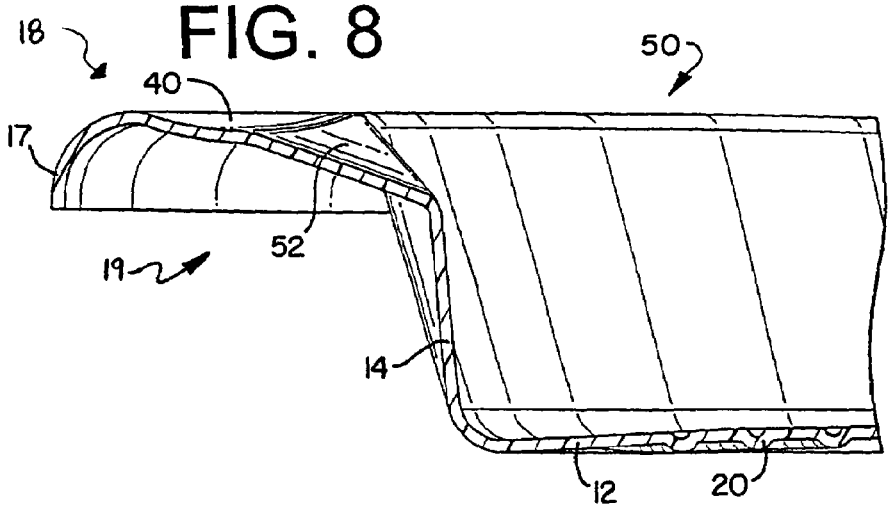
FIG. 8 is a cut away view of the plate thumb handle with a gusset of FIG. 7.

FIGS. 7 and 8 show a perspective view of a plate 50 having a gusset 52 in the thumb handles 18 and a cross-section view of the thumb handle 18, respectively. The thumb handles 18 are to be wide enough to suit individuals with large thumbs; however, wide thumb handles 18 provide less plate structure rigidity. As the thumb handle grips move away from the sidewall 14, the moment of force, the product of force multiplied by the perpendicular distance, requires less force to deflect a given distance. Another problem with thumb handles are the hinge points. The thumb handles 18 meet the sidewall 14 to form a sharp corner or a hinge point. The hinge point is a high stress area and makes the product weak. The sharp corner may be broken down with a generous radius, but the sharp corner may look better, therefore, the gusset 52 may serve as design feature to correct the rigidity with the following purposes. First, it shortens the perpendicular line of force and second, the gusset 52 acts as a truss or a brace that takes some of the load of weight from the plate. Additionally, the gusset 52 serves as a stiffening feature. The gusset 52 softens the angle at the flex point where the thumb handles 18 meet the sidewall. The more gradual slope of the angles provided as a result of the gussets 52 add strength and increase the amount of force necessary to deflect the thumb handles 18. The path of the plate material changes direction as it travels from the sharp corner to the bottom of the gusset 52. This interruption in the path gives the product strength in that area. The gusset 52 is preferably centered in a portion of the thumb handle 18 around the major axis.

Figure 9:
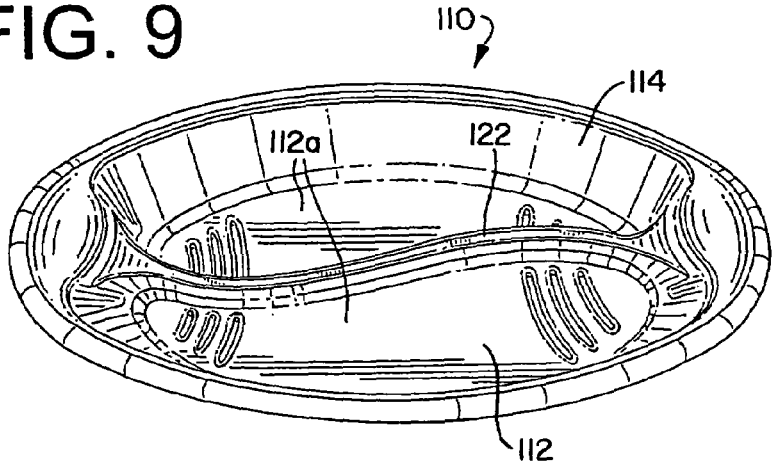
FIG. 9 is a perspective view of a plate, showing a compartmental divider.

As shown in FIG. 9, one embodiment of the present invention is a plate 110 similar to that of FIG. 1 with the addition of a curved dividing wall 122. The curved dividing wall 122 creates distinct food receptacle compartments 112*a* of the food-contact area 112 on the plate 110. The food receptacle compartments 112*a* serve to allow a diner to segregate the items placed on the plate 110 into two sub-categories. This aspect is particularly useful when food or items are incompatible. The asymmetrical food receptacle compartments 112*a* formed by the curved dividing wall 122 serve the purpose of adding strength and rigidity to the plate 110. The curve of the dividing wall 122 inhibits the plate 110 from bending along a straight line, rather the curved dividing wall 122 gives support to the food-contact area receptacle compartments 112*a* by strengthening the capacity of the food receptacle compartments 112*a* along the line of the curved dividing wall 122. Also, configuring or positioning the curved dividing wall 122 along the general line of the major axis of the plate 110 increases the rigidity of the most likely location that such a plate 110 would collapse and fold under a heavy load, the center line along the plate's minor axis. A similarly positioned straight dividing wall would not provide this benefit.

Figure 10:
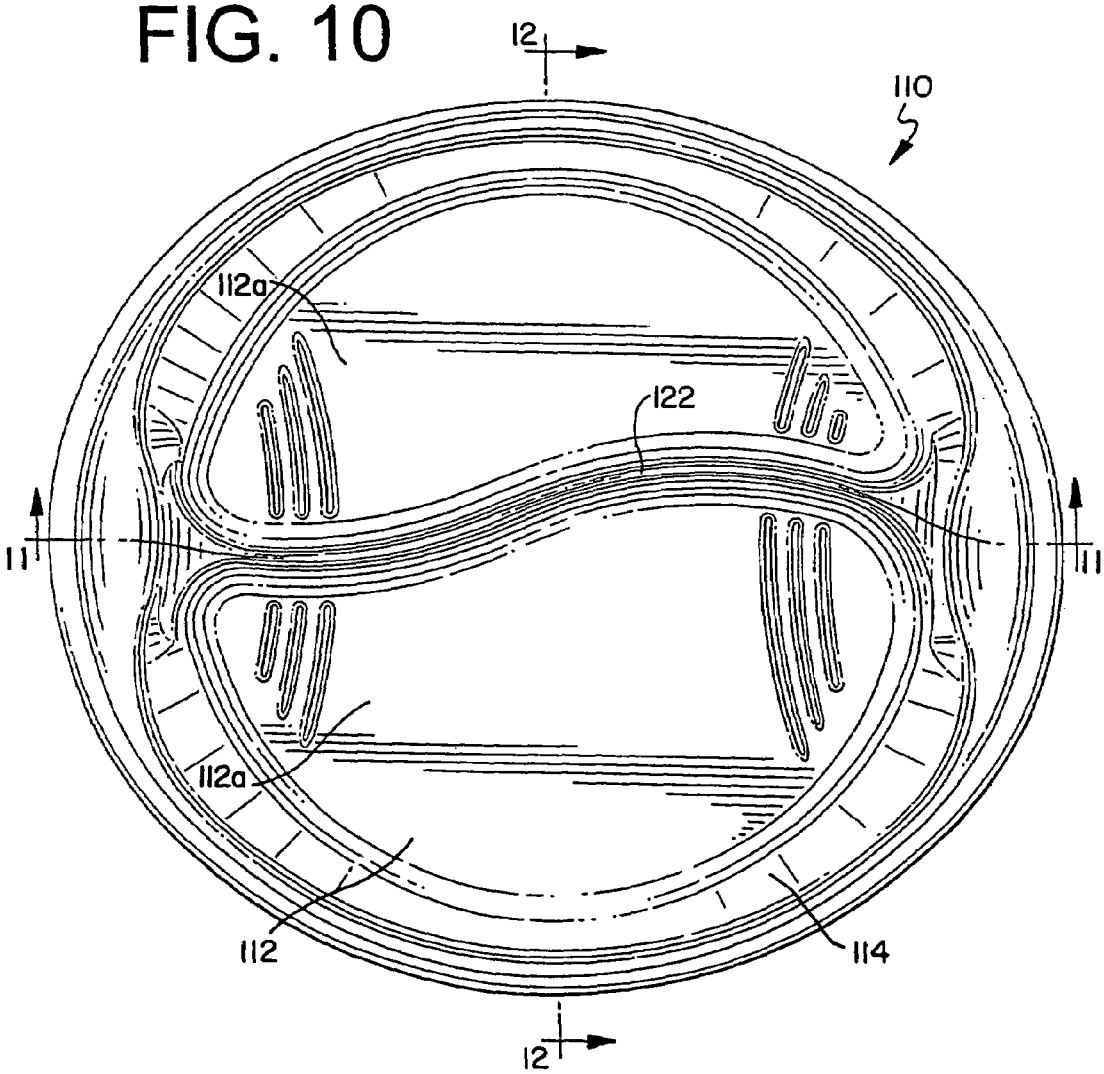
FIG. 10 is a top view of the plate of FIG. 9, showing the divided substantially circular food-contact area with the oval plate rim.

FIG. 10 is a top view of the plate 110 of FIG. 9. From atop the plate 110, the size and shape of the food receptacle compartments 112*a* show that one compartment is larger than the other. The food receptacle compartments 112*a* form two nearly kidney shaped dissimilarly sized hemispheres with the dividing wall 122 curving generally near the line of the plate's major axis.

Figure 11:
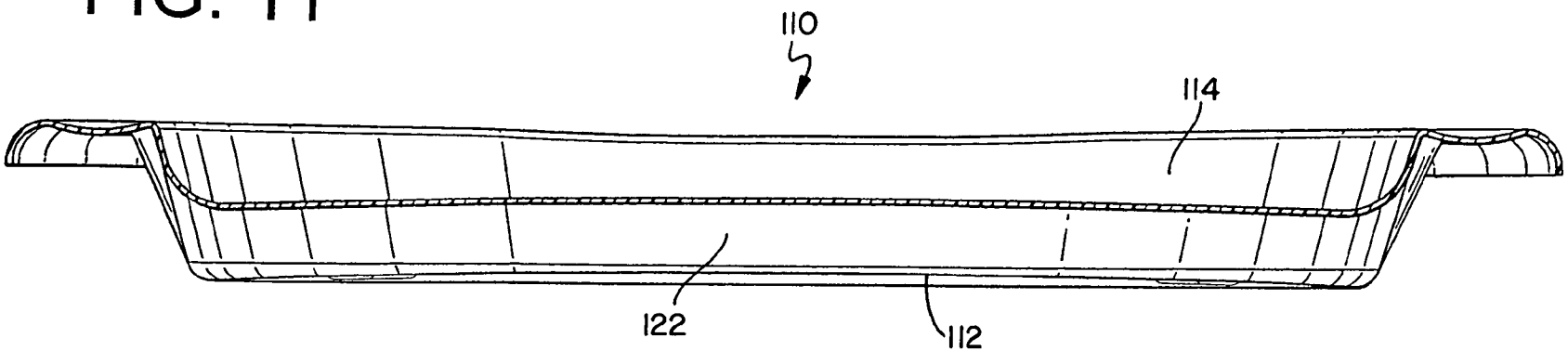
FIG. 11 is a side view of the plate of FIG. 9 cut along the major axis.

FIG. 11 is a cross section view of the compartmentalized plate 110 of FIGS. 9 and 10 cut along the major axis. This embodiment has a curved dividing wall 122 approximately half the height of the sidewall 114. In a preferred embodiment, the angles of the dividing wall 122, relative to the integrated portion of the food-contact area receptacle compartments 112, and the sidewall 114 angles, are substantially similar. The curved dividing wall 122 is raised from the surface of the food-contact area and forms the food receptacle compartments. The dividing wall 122 can be relatively low in relation to the sidewall 114 or in another preferred embodiment, taller than the sidewall 114. In yet another preferred embodiment, the food-contact area receptacle compartments 112 of a divided plate are maximized by having a relatively short dividing wall 122, having angles nearly perpendicular to the food-contact area.

Figure 12:
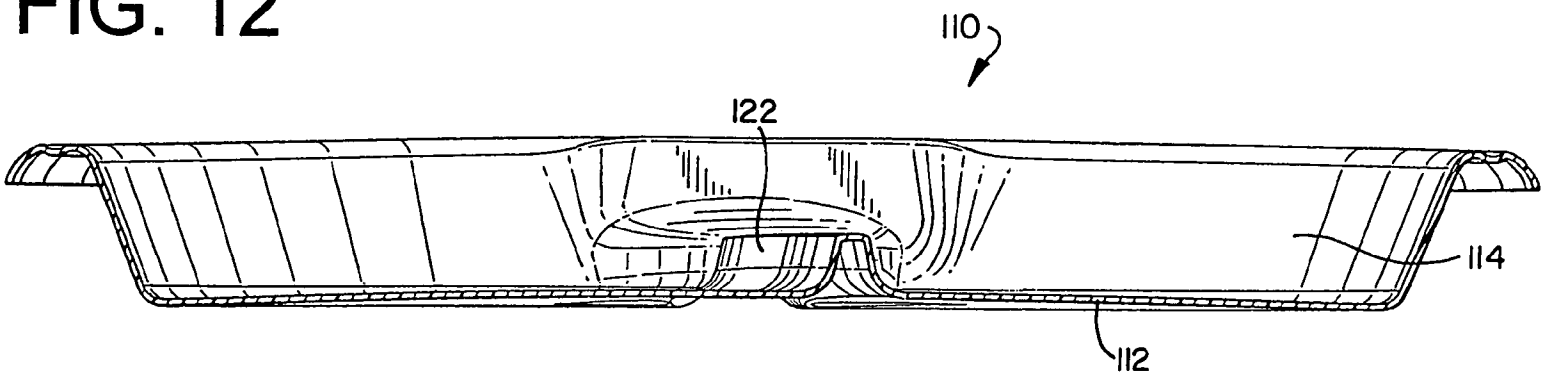
FIG. 12 is a side view of the plate of FIG. 9 cut along the minor axis.

In FIG. 12, the angles and height of the curved dividing wall 122 relative to the food receptacle compartments 112 can be substantially different than the height and the angle of the sidewall 114 of the plate 110. The height and angle of the curved dividing wall 122 can be greater or less than the sidewall 114 depending on the segregation requirements of the items to be stored in the food receptacle compartments 112. The angles and height of the curved dividing wall 122 also determine the size of the food receptacle compartments 112, where a large angle (about 120 degrees to 170 degrees) of a relatively high curved dividing wall 122 can minimize the size of the bottom area of the food receptacle compartments 112. The absolute height of the curved dividing wall 122 is preferably similar to the height of the sidewall 114, with a steep, nearly vertical angle, optimizing the segregation capacity of the food receptacle compartments 112 while retaining the food items on the plate 110.

Other embodiments of a multi-compartment plate 110 can be fabricated under the same design concept, the food receptacle compartments 112 being separated by a curvy shaped dividing wall 122. The number of compartments can be determined by the amount of separate food items the plate is designed to hold. The curved dividing wall 122 is positioned to strengthen the holding capacity of the food receptacle compartments 112. The addition of the curved dividing wall 122 supports the structure of the plate 110 along its center line or minor axis. Holding a plate that is loaded with heavy items by the two thumb handles 118 at the ends of the major axis naturally puts the most amounts of strain directly on the minor axis, encouraging the plate 110 to fold along the center line. The curved dividing wall 122 increases the plate's tolerance for a heavier load.

Each of the food receptacle compartments 112 divided and partitioned by the curved dividing wall 122 can be separately pitched. The slope of any and every food receptacle compartment 112 can be of a varied and unique angle or direction to drain fluids to the edges of the food receptacle compartment 112. The downward slant can be directed to the outer edge of the plate 110, or for other applications, toward the middle of the plate 110. The pitch of each food receptacle compartments 112 can be steep or gradual, depending again on the desired application.

While the specific embodiment has been illustrated and described, numerous modifications come to mind without significantly departing from the spirit of the invention, and the scope of protection is only limited by the scope of the accompanying claims.

What is claimed is:

1. A disposable plate comprising:

a substantially circular base;

an oval rim having an oval outer edge and an inner edge, the rim comprising a pair of opposing handles positioned between the inner and outer edges, wherein each handle has at least one depression for facilitating grasping of the plate, the rim further having a vertical downturn flange extending downward and outward from the entire periphery of the outer edge of the rim, wherein a portion of the rim cooperates with the flange to define an annular cavity below an underside of the rim; and a sidewall comprising a lower circular edge integral with a peripheral edge of the base and a substantially oval upper edge integral with the inner edge of the rim, wherein the plate is disposable and formed from a material selected from the group consisting of plastics including thermoplastics and thermosets.

2. The disposable plate of claim 1 wherein the handle has an inner periphery that is adjacent the upper sidewall edge, the inner periphery having a continuous convex configuration when viewed from a vantage point located within the base.

3. The disposable plate of claim 1 wherein the oval rim has a major axis and a minor axis, wherein each handle is positioned on the major axis.

4. The disposable plate of claim 1 wherein at least one of the opposing handles comprises an angled gusset at the transition of the sidewall to the handles to increase structural rigidity of the area.

5. The disposable plate of claim 1 wherein an internal angle between the sidewall and the base is in the range of from 90 degrees to less than 180 degrees.

6. The disposable plate of claim 1 further comprising:

a divider wall dividing the planar base to form a plurality of asymmetrical plate compartments.

7. The disposable plate of claim 1 wherein the flange has a terminal edge positioned below the upper edge of the sidewall.

8. The disposable plate of claim 6 wherein the divider wall has a curvilinear configuration.

9. The disposable plate of claim 8 wherein the divider wall has two opposed ends, each of said two ends mating with a sidewall portion at a major axis of the outer rim edge.

10. The disposable plate of claim 1 wherein the handle has a continuous concave inner periphery when viewed from a vantage point located within the handle.

11. A disposable plastic plate comprising:

a substantially planar circular base;

a rim having an oval outermost periphery, a pair of opposing handles positioned inward of the outermost periphery, a flange downwardly depending from the entire outermost rim periphery, and an inner edge interior to the flange and disposed about the entire rim; and a sidewall comprising a lower portion integral with the base and a upper portion integral with the inner edge of the rim, wherein the lower portion is circular at an edge integral with the base and the upper portion is substantially oval at an edge integral with the inner edge of the rim;

wherein the flange has a terminal edge positioned below both the inner edge of the rim and an upper edge of the sidewall.

12. The disposable plate of claim 11, wherein a portion of the rim cooperates with the flange to define an annular cavity positioned below an underside of the rim.

13. The disposable plate of claim 11, wherein the sidewall forms an internal angle with the base, and wherein the internal angle at a major axis of the inner rim edge is less than the internal angle at a minor axis of the inner rim edge.

14. A disposable plate comprising:

a substantially planar circular base;

a rim having an oval outer periphery with a first major axis, the rim further having a substantially oval inner edge with a second major axis that is aligned with the first major axis, the rim further having a pair of opposing depressed handles positioned along the first and second major axes, the rim further having a flange depending downward from the entire outer rim periphery; and a sidewall extending between the base and the rim;

wherein the plate is disposable and formed from a material selected from the group consisting of plastics including thermoplastics and thermosets.

15. The disposable plate of claim 14, wherein the sidewall forms an internal angle with the base and wherein the internal angle increases outward moving along the sidewall from an area proximate a minor axis of the oval rim toward an area of the sidewall proximate the first and second major axes of the oval rim.

16. The disposable plate of claim 14, wherein the sidewall and the base define an internal angle, and wherein the internal angle at the first major axis is less than the internal angle at a minor axis of the rim.

17. The disposable plate of claim 16, wherein sidewall has an intermediate region between the first major axis and the minor axis, and wherein the internal angle at a portion of the intermediation region is greater than the internal angle at the first major axis.

18. The disposable plate of claim 16, wherein sidewall has an intermediate region between the first major axis and the minor axis, and wherein the internal angle at a portion of the intermediation region is greater than the internal angle at the minor axis.

19. A disposable plastic plate comprising:

a circular base;

a sidewall extending upward from the periphery of the base; and, a rim extending outward from the sidewall, the rim having an inner edge integral with the sidewall, an oval outer edge and a pair of opposed handles positioned radially inward of the outer edge, wherein each handle is positioned on a major axis of the outer rim edge;

wherein an extent of the sidewall and inner edge proximate each handle extends radially inward to define an internal sidewall protrusion with a continuous convex configuration when viewed internally from a center of the base.

20. The disposable plastic plate of claim 19, the sidewall having a height that remains constant throughout the sidewall, including at the sidewall protrusion.

21. The disposable plastic plate of claim 19, wherein each handle includes a depression.

22. The disposable plastic plate of claim 19, the rim further comprising a flange that depends downward from the entire outer edge of the rim.

23. The disposable plastic plate of claim 19, wherein the base has at least one tactile member.

24. The disposable plastic plate of claim 23, wherein the tactile member is positioned radially inward of a base periphery and the tactile member comprises a plurality of raised projections.

25. A disposable plastic plate comprising:

a substantially planar circular base;

a rim having an oval outermost periphery, a pair of opposing handles positioned inward of the outermost periphery, a flange downwardly depending from the entire outermost rim periphery, and an inner edge interior to the flange and disposed about the entire rim; and a sidewall comprising a lower portion integral with the base and a upper portion integral with the inner edge of the rim, wherein the sidewall forms an internal angle with the base, and wherein the internal angle at a major axis of the inner rim edge is less than the internal angle at a minor axis of the inner rim edge;

wherein the flange has a terminal edge positioned below both the inner edge of the rim and an upper edge of the sidewall.

* * * * *